US005655668A

United States Patent [19]

Drenth

[11] Patent Number: 5,655,668

[45] Date of Patent: Aug. 12, 1997

[54] METHOD AND APPARATUS FOR VERIFYING WHETHER DOCUMENTS HAVE BEEN SEPARATED FROM AN OPENED ENVELOPE

[75] Inventor: Klaas Drenth, Ureterp, Netherlands

[73] Assignee: Hadewe B.V., Netherlands

[21] Appl. No.: 706,066

[22] Filed: Sep. 4, 1996

Related U.S. Application Data

[63] Continuation of Ser. No. 175,548, Dec. 30, 1993, abandoned.

[30] Foreign Application Priority Data

Dec. 27, 1992 [NL] Netherlands ..... 9202297

[51] Int. Cl.[6] ..... B07C 5/12; B65H 7/12

[52] U.S. Cl. ..... 209/603; 209/900; 271/263; 271/265.04; 53/52; 53/381.5; 53/492; 53/504; 324/230

[58] Field of Search ..... 209/556, 559, 209/565, 601, 603, 604, 900; 271/262, 263, 264, 265.01, 265.02, 265.03, 265.04; 53/52, 381.3, 381.5, 381.7, 492, 504; 324/230

[56] References Cited

U.S. PATENT DOCUMENTS

| | | | |
|---|---|---|---|
| 3,026,419 | 3/1962 | Aweida et al. | 271/263 X |
| 3,712,468 | 1/1973 | Wenner et al. | 209/601 X |
| 4,016,708 | 4/1977 | DeHart . | |
| 4,113,105 | 9/1978 | DeHart et al. | 209/549 |
| 4,576,287 | 3/1986 | Bingham et al. | 209/604 X |
| 4,866,915 | 9/1989 | Wise | 53/492 |
| 4,966,354 | 10/1990 | Grunder | 271/263 X |
| 5,131,545 | 7/1992 | Owen | 53/381.5 X |
| 5,238,123 | 8/1993 | Tovini et al. | 209/604 X |
| 5,265,733 | 11/1993 | Hoekstra et al. | 209/603 |

FOREIGN PATENT DOCUMENTS

| | | | |
|---|---|---|---|
| 0 169 145 | 1/1986 | European Pat. Off. . | |
| 0 225 288 | 6/1987 | European Pat. Off. . | |
| 0 233 818 | 8/1987 | European Pat. Off. . | |
| 2 030 027 | 10/1970 | France . | |
| 4140253 | 5/1992 | Japan | 271/263 |
| 7 811 762 | 6/1980 | Netherlands . | |
| WO88/01543 | 3/1988 | WIPO . | |
| WO94/04378 | 3/1994 | WIPO . | |

OTHER PUBLICATIONS

Three-page European Search Report.

*Primary Examiner*—William E. Terrell
*Assistant Examiner*—Tuan Nguyen
*Attorney, Agent, or Firm*—Burns, Doane, Swecker & Mathis, L.L.P.

[57] ABSTRACT

A method and apparatus for checking whether documents have been separated from an opened envelope includes conveying an envelope past an input transducer which measures a characteristic, based on light shown through the envelope, of each individual envelope along a measuring path parallel to the direction of movement of the envelope. From the measured characteristic, a value profile is determined, from which a reference value for each envelope is determined. The value profile is used then to calculate an extreme limit value for each envelope. An envelope-suspect signal is generated if the value profile lies beyond the limit value over a specified minimum substantially continuous measuring distance. The system calculates the values for each envelope, and accordingly, envelopes of greatly diverse characteristics may be reliably checked in random order.

21 Claims, 4 Drawing Sheets

METHOD AND APPARATUS FOR VERIFYING WHETHER DOCUMENTS HAVE BEEN SEPARATED FROM AN OPENED ENVELOPE

This application is a continuation of application Ser. No. 08/175,548, filed Dec. 30, 1993, now abandoned.

BACKGROUND OF THE INVENTION

The invention relates to a method for checking whether documents have been separated from opened envelopes, in which each envelope is conveyed along at least one input transducer, which measures a characteristic of that envelope along a measuring path extending over that envelope.

Such a method is disclosed in U.S. Pat. No. 4,016,708. In this known method an opened envelope which has been subjected to an operation for separating therefrom the documents received therein, is passed along two detectors arranged at a distance from each other in the direction of conveyance, each detector comprising a light source and a photocell arranged on the other side of the transport path, opposite the associated light source. The photocells are each adapted for activating an associated logic circuit if the amount of light received falls below an amount of light that passes through the greater part of a completely emptied envelope. False alarms as a consequence of reduced transparency at the location of adhesive edges, printings, and the like are avoided in that an envelope-suspect signal is produced only when both detectors activate the logic circuit simultaneously.

A drawback of this method is that it is only suitable for processing substantially identical return mail. In the processing of different envelopes that allow different amounts of light to pass, on the one hand the presence of a document is signaled erroneously when thick and dark envelopes pass the detectors and on the other hand the presence of a document is not signaled when relatively transparent envelopes with a relatively transparent document pass the detectors.

U.S. Pat. No. 4,113,105 discloses a method for verifying the empty status of envelopes, in which the signals coming from three light-sensitive sensors arranged along a line directed transversely to the direction of conveyance are compared with each other and an envelope-suspect signal is produced if the signal of the central sensor differs from that of the lower or upper sensor for a specified minimum period of time. Moreover, the signal of the central sensor is compared with a specified value and an envelope-suspect signal is produced if this comparison reveals undesired differences.

In this method envelopes and documents of different transparencies can be processed in a random order, but documents of such width that they pass under the central as well as the upper and lower sensors are detected only if the total transparency decreases to such an extent that the comparison of the signal produced by the central sensor with the above-mentioned specified value is a reason for that. This disadvantage is of major importance because documents are generally mailed in envelopes into which they fit with little clearance. A further drawback of this method is that it is only suitable for processing envelopes having one specified dimension transverse to the direction of conveyance, because the upper and the lower sensor must pass closely along the edge of the envelope. A yet further drawback of this method is that when a thick and/or dark envelope passes the sensors, an envelope-suspect signal is also produced if no document is being carried along with such envelope but the comparison of the signal produced by the central sensor with the specified value mentioned does provide a reason for it.

International patent application WO 88/01543 discloses a method for the verification of the empty status of envelopes, in which the thickness of the envelopes is measured. This measured thickness is compared with a value determined during a test cycle. In this method, too, it is not properly possible to process different envelopes in random order because they may have different thicknesses. The envelopes to be processed must have the same thickness as the envelopes supplied in the test cycle.

SUMMARY OF THE INVENTION

The object of the invention is to provide a method by which a larger variety of envelopes can be checked in a random order for the presence of any documents left behind in the envelopes.

This object is realized according to the present invention in that for each envelope, a value profile is determined from the measuring result, a reference value for that envelope is determined from the value profile, an extreme limit value for that envelope is determined from the reference value, and an envelope-suspect signal is generated for that envelope if the value profile lies beyond the limit value over a predetermined minimum substantially continuous distance.

The feature that on the basis of the value profile associated with a particular envelope a reference value associated with the envelope material of that envelope is determined for each envelope separately, makes it possible to compare the greatest or smallest value of each envelope with a reliable extreme limit value which the envelope, in view of the value associated with the envelope material of the envelope, might have in the absence of documents. Because in this manner for each envelope an associated limit value is determined, envelopes of different values can be processed in random order.

If the limit value is temporarily exceeded as a result of stamps and adhesive edges, this does not lead to erroneous envelope-suspect signals, because such signals are exclusively produced if the value profile comprises a value lying beyond the limit value over a specified minimum continuous distance. This distance should preferably be chosen to be greater than the largest common stamp dimension in the direction of conveyance.

Preferably, the values referred to each represent a thickness, but may also represent, for instance, the intensity of the light having passed through the envelope or, conversely, a degree of darkening. The values referred to may also each represent a capacitance of a capacitor formed by two plates on opposite sides of the envelope with a non-removed document, if any.

The stored value profile may further consist of a representation of a continuous course as well as of a succession of separate values.

The invention may further be embodied in an apparatus for checking whether documents have been separated from envelopes, comprising a conveyor track for passing envelopes to be checked along an inspection station one by one, at least one input transducer arranged along the conveyor track for generating an output signal which is variable depending on a characteristic of the envelope material passed along the input transducer, and means for generating an envelope-suspect signal, comprising data processing means, coupled with the input transducer, adapted for determining a value profile for each envelope from the signal originating from the input transducer, storing the value profile, determining a reference value associated with the envelope material from the value profile, determining an extreme limit value from the reference value, and generating an envelope-suspect signal if a continuous part of the value profile lies beyond the limit value over a predetermined minimum substantially continuous distance.

DETAILED DESCRIPTION OF MOST PREFERRED AND OTHER MODES OF THE INVENTION

The invention is first of all explained with reference to FIGS. 1 and 2.

Figure 1:
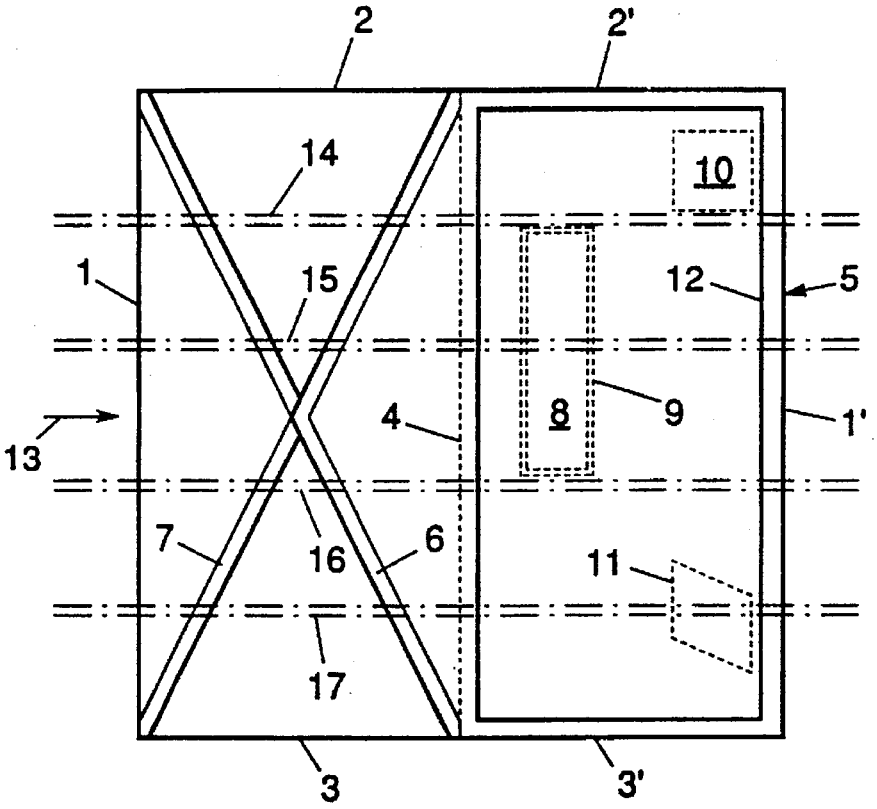
FIG. 1 shows an example of an envelope with measuring paths extending over it.

FIG. 1 shows an example of an envelope 5 which has been opened along three sides 1, 1', 2, 2', 3, 3' and folded open about a fourth side 4. The envelope comprises adhesive edges 6, 7, a window 8 connected with a panel of the envelope 5 along an adhesive edge 9, a stamp 10 and a relief printing 11. A document 12 is located on the envelope 5.

To practice the method according to the invention, the opened envelope 5 is conveyed along input transducers each measuring a characteristic of the envelope 5 along a measuring path 14–17 extending over that envelope 5, parallel to the direction of conveyance (arrow 13). Thus, for each measuring path 14–17 a measuring result is obtained, which, for each input transducer, consists of a varying measured value or a number of successive measured values.

Starting from this measuring result, a value profile is determined. One such value profile 18, associated with the measuring path 15 in FIG. 1, is shown in FIG. 2. In practice, such a value profile 18 may look slightly different because the input transducers react with a delay and may react with some overshoot to sudden variations, but in the practice of the present invention incorrect signalling resulting from such disturbances can be simply prevented, as will be explained hereinafter. This value profile 18 forms a representation in which the measured value is plotted against the displacement of the envelope. Further, the broken line 19 in FIG. 2 indicates the course of the value profile 18 in the absence of the document 12.

The value profile is analyzed for the purpose of determining a reference value associated with the envelope material, i.e. the material from which the walls of the envelope are made. This can be realized in different manners and will be further explained on the basis of two examples.

On the basis of the reference value, an extreme limit value is determined. The manner in which the limit value is determined starting from the reference value, depends on the configuration in which the envelope 5 is passed along the input transducers and on the manner in which the reference value is determined. This will also be explained hereinafter on the basis of the two examples mentioned.

Finally, the value profile 18 is compared with the limit value and an envelope-suspect signal is generated if the value profile 18 lies beyond the limit value over a specified minimum substantially continuous distance. This envelope-suspect signal, for that matter, can also consist in the absence of a signal indicating that the envelope has been found to be non-suspect.

Because the reference value is determined after the value profile 18 has been determined, the correct value associated with the envelope material can be reliably identified as the reference value.

The limit value can be determined anew for each envelope on the basis of the reference value associated with the envelope material. This makes it possible to process different envelopes in random order. The method does not rely on passing the input transducers along specific areas of the envelope and thereby allows envelopes of considerably different dimensions to be processed in random order as well.

Although hereinabove the invention has been explained on the basis of a method in which the envelope is scanned along several measuring paths, it is also possible to limit scanning to a single measuring path.

The values referred to can for instance represent the intensity of the light passing through the envelope or, conversely, the degree of darkening caused by the envelope. The values referred to can also each represent a capacitance of a capacitor formed by two plates on opposite sides of the envelope. Preferably the values each represent a thickness of a portion of the envelope—with a document, if any—against which the input transducer abuts at a given time. The advantage of scanning the thickness of the envelopes is that the color of envelopes and printings provided on the envelopes do not cause any disturbance of the measuring results. Moreover, measurement of the thickness also makes it possible to reliably check material that allows very little or no light to pass through it (for instance very thick or dark material). For the purpose of scanning the thickness, the input transducers are designed as scanners. In the following elaborations of the invention, the values are always determined through thickness measurement using scanners.

If, instead of values representing the thickness, values are used which decrease according as more layers of material are passed along an input transducer, it is understood that in that case at such points in the following examples where a greatest value is chosen, a smallest value must be chosen and the other way round. Further, in accordance therewith, wherever an upper limit is used, in that case a lower limit should be used and the other way round.

The determination of the reference and the limit value will now be further explained on the basis of a first elaboration of the invention.

In this elaboration of the invention, the envelope 5 is conveyed along the scanner in the configuration shown in FIG. 1. The reference value is found by identifying a smallest value of the value profile which is substantially constant over a path of a specified length and determining a value corresponding with the substantially constant value of such portion. This last value is stored as reference value. The reference value can for instance correspond with the average value of such portion or, if the value of such portion is constant throughout, be identical to the value of such portion.

Because the envelope 5 in passed along the scanner in unfolded condition, there will virtually always be a single-walled portion of the envelope 5 where no document 12 is located. This portion, if the envelope 5 does not comprise a window, will have the smallest value that is substantially constant over a specified distance. In FIG. 2 the specified distance is indicated by a size indication 20 and the reference value is indicated by a size indication 21.

The limit value is determined by adding a tolerance value to this reference value to avoid envelope-suspect signals in the case of small fluctuations in the thickness of the wall of the envelope 5. In FIG. 2 the tolerance value is indicated by a size indication 22, the limit value is indicated by a size indication 23 and the corresponding limit value level is indicated by a chain-dotted line 24. The tolerance value may be a fixed value, but may also be a value depending on the reference value.

As explained hereinabove, an envelope-suspect signal is generated if the value profile 18 lies beyond the limit value over a specified minimum substantially continuous distance. This distance is indicated in FIG. 2 by the size indication 25 and is just greater than the sizes of the stamp 10 and the relief printing 11 in the direction of conveyance (FIG. 1), so that these elements and the adhesive edges 6 and 7 cannot give rise to an incorrect envelope-suspect signal.

Figure 2:
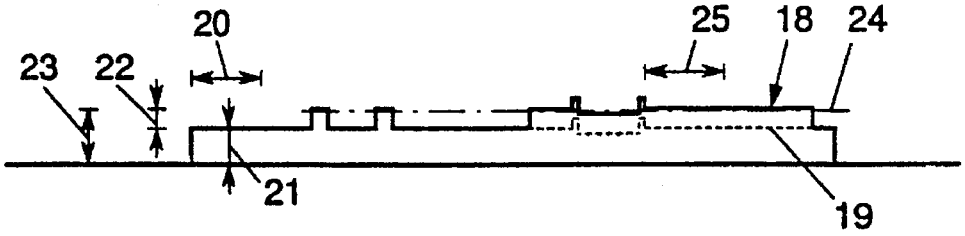
FIG. 2 shows a value profile based on the measuring result obtained along one of the measuring paths according to FIG. 1.

As is evident from FIG. 2, the value profile 18 lies beyond the limit value 24 over a distance greater than the minimum distance 25, so that an envelope-suspect signal will be generated.

The measured result is preferably inputted into a digital data processor via an analog-digital converter. This can for instance be a single chip microcomputer with extensions, such as the Philips PCB 80C552.

In order to make processing in such a processor possible, it is advantageous if the value profile is made up of separate successive values and does not have a continuous course such as is shown in FIG. 2 for convenience. In that case, the smallest value of the value profile that is substantially constant over a path of a specified length is identified by identifying series of substantially identical values occurring at a specified number of times in succession and selecting therefrom the series with the smallest value.

If the scanner and the analog-digital converter are suitably chosen, such a step size of the inputted values will be obtained that it is sufficient to identify series of completely identical values. A favorable resolution of half the thickness of an airmail envelope can for instance be obtained by using a scanner with a stroke of 5 mm and a 10-bit analog-digital converter.

According to FIG. 2 the length of the path 20 over which a portion of the value profile 18 must be substantially constant to qualify as a basis for determining the reference value 21, is longer than the length of the window 8 in the direction of conveyance. However, in the case where a document 12 is absent—resulting in a value profile that follows the broken line 19—but where a larger window in the direction of conveyance is present, a value associated with the window material, instead of a value associated with the envelope material, would be stored as reference value, because the window material is typically thinner than the envelope material. This in turn might lead to a situation where a part of the adhesive edge 9 of the window 8 exceeds the limit value for so long that an envelope-suspect signal is generated, in spite of the fact that, as stated, no document is present on the envelope.

This problem can be obviated by skipping parts of the value profile 18 below a specified threshold value in determining the reference value 21. As a result, values associated with window material are automatically skipped in determining the reference value 21.

This threshold value should preferably be selected such that it is greater than most values associated with windows and smaller than the smallest value found in envelope material. A suitable value is for instance a value corresponding with a thickness of 35–45 μm. This is just smaller than the thinnest airmail envelopes, which have a thickness of approx. 50 μm.

To limit calibration problems it is preferred that prior to the verification of each envelope a value measured by the scanner be stored as a base value associated with that envelope and the measured values be stored and processed as differences relative to that base value.

Figure 3:
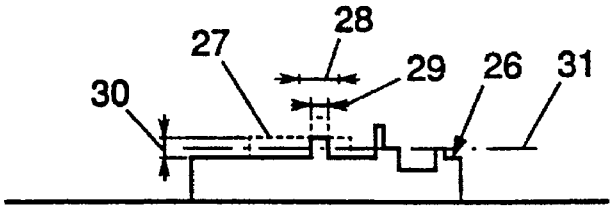
FIG. 3 shows another example of a value profile based on the measuring result obtained along a measuring path extending over a folded envelope.

A second example of a manner in which the reference value and the limit value can be determined will now be further explained with reference to FIG. 3. FIG. 3 shows a value profile 26, which has been obtained along a path, corresponding with the measuring path 15 in FIG. 1, over an identical envelope, but in this case the envelope is passed along the scanner in folded condition and no document is being carried along with the envelope. The stripe-dotted line 27 indicates an example of an alternative course of the value profile. This course is obtained in a situation where the envelope does carry along a document.

When the envelope is passed along a scanner in folded condition, it is not properly possible to reliably identify and measure a portion of the envelope where exclusively a known number of layers of the envelope material are present and on the basis of which a reference value associated with the envelope material can be determined.

In such a situation the reference value can be obtained in the following manner.

Prior to the passage of the envelope, a value measured by the scanner is stored as a base value.

Further, a first part of the value profile is identified which has a substantially constant value, is limited by parts having deviating values and has a length within a specified range. This range is selected such that conventional dimensions, in the direction of conveyance, of adhesive edges 6, 7 intersecting the measuring paths (FIG. 1) fall within such range. Examples of an upper limit and a lower limit of this range are indicated in FIG. 3 by the size indications 28 and 29, respectively. The value corresponding with the substantially constant value of the first part thus forms a value associated with a part of the envelope comprising an adhesive edge.

Further, a second, adjacent part of the value profile 26 having a substantially constant value and a specified minimum length is identified. The minimum length referred to is desirable to prevent storage of values influenced by disturbances at sudden transitions. A suitable minimum length may for instance be the lower limit 29 of the range referred to above. The value corresponding with the substantially constant value of the adjacent portion thus forms a value associated with a portion of the envelope next to the portion comprising an adhesive edge.

The magnitude of the difference in thickness between the first part comprising an overlap in the form of an adhesive edge and the adjacent part equals the thickness of a single wall of the envelope material, regardless of whether this part also comprises a document part (compare also the profiles 26 and 27). The reference value associated with the envelope material can now be simply determined by calculating the difference between the substantially constant values of the first and the adjacent portions.

The difference referred to is then stored as the reference value. It is shown in FIG. 3, indicated by the size indication 30. From this the limit value is determined by adding to the base value twice the reference value and a tolerance value. The limit value thus corresponds with a thickness being the sum of twice the wall thickness of the envelope wall and a tolerance value. A possible level of the limit value is shown in FIG. 3, by way of example, by the chain-dotted line 31.

As is evident from FIG. 3, the value profile 26 associated with an envelope without a document does exceed the lower limit but not over a continuous path of a length greater than the minimum length 25 shown in FIG. 2. Accordingly, in the case of such a value profile, no envelope-suspect signal is generated. The alternative course 27 of the value profile associated with a portion of the envelope where a document is located does exceed the limit value 31 over a continuous distance greater than the minimum distance 25 according to FIG. 2.

It is noted that this method can also be used if an envelope is passed along a scanner in a configuration as shown in FIG. 1. In that case, however, the limit value should be determined by summation of the reference value (a single time instead of twice that value) and a tolerance value.

It also holds for the method according to this second example that if a digital data processor is used, the value profile is preferably made up of separate successive values. In that case, as a first portion a series of substantially identical values are identified, whose number lies between a specified minimum and a specified maximum, and as adjacent portion a series including at least a specified number of substantially identical values are identified.

To prevent the reference value from being calculated on the basis of the difference between a portion of the envelope comprising a portion of an adhesive edge of a window and an adjacent portion, so that a value associated with the window material would be stored as reference value, the difference referred to can be compared with a specified threshold value and be stored as reference value only if it is greater than the threshold value referred to. Thus the chance of erroneous envelope-suspect signals can be limited.

In addition, or alternatively, in the case where two or more portions of a value profile have been identified that have substantially constant values, are limited by portions having deviating values and have a length within a specified range, the portion having the greatest substantially constant value can be identified as the first portion of the value profile referred to. This step, too, can prevent the storage of a value associated with window material as reference value, which would give rise to an increased chance of an erroneous envelope-suspect signal.

In some applications it is of major importance that not a single document be discarded with an envelope. In such cases, after the passage of an envelope, an envelope-suspect signal will moreover be generated if no value associated with that envelope is stored as reference value. Such a situation can for instance occur if adhesive edges, window, stamp, address label and similar irregularities have a particularly unfavorable position relative to each other.

The tolerance value referred to is preferably equal to the threshold value referred to. In that case both the threshold value and the tolerance value may be selected such that values associated with the window material are not responded to. Just as the threshold value ensures that no value associated with the window material is stored as reference value, so a tolerance value identical thereto ensures that values associated with adhesive edges of a window do not exceed the limit value, so that a portion of an adhesive edge 9 of a window 8 that is directed in the direction of conveyance does not lead to an envelope-suspect signal if no document 12 is carried along with the envelope 5.

When the envelope 5 is conveyed along at least two scanners in positions spaced relative to each other transverse to the direction of conveyance, it is advantageous if for each scanner a base value is stored and the measured values are stored and processed as differences with regard to the base value associated with that scanner. Thus, relatively large differences between the signals coming from the different scanners can be accepted without this leading to errors in the verification of the envelopes.

Naturally, the chance of detection of a document carried along with the envelope increases according as scanning is effected along a larger number of measuring paths, especially where the detection of small documents is concerned. An increased number of scanners, however, can also be used to reduce the chance of erroneous envelope-suspect signals.

For that purpose, it is possible, for instance, that a particular signal observable by the operator of the apparatus is only generated if envelope-suspect signals have been caused by measuring results coming from at least two immediately adjacent scanners. If one scanner runs over a portion of a relatively thick adhesive edge 9 of a window 8 that is directed in the direction of conveyance, the chance of an adjacent scanner likewise running over a portion of a relatively thick adhesive edge 9 of a window 8 that is directed in the direction of conveyance is very small. If this step is taken, therefore, there is only a slight chance of an erroneous operator-observable signal indicating that an envelope has not been completely separated from its contents.

Naturally, such operator-observable signal may also consist in the absence of a 'check-complete' signal indicating that the envelope has been found to have been separated completely from its contents. Such 'check-complete' signal can for instance be used as a signal for starting a next cycle of an apparatus for separating envelopes from the documents received therein.

The chance of an erroneous issue of an operator-observable signal indicating that the verified envelope is suspect can be further reduced if such signal is moreover generated only if the portions of the respective value profiles that are located beyond the limit value and on the basis of which the envelope-suspect signals were generated are associated with adjacent measuring path portions that overlap in the direction of conveyance.

An even further reduction of the chance of an erroneous operator-observable signal can be achieved if this signal is moreover generated only if the adjacent measuring path portions overlap in the direction of conveyance over a specified minimum distance.

Instead of a single representation of the course of the thickness of the envelope along a measuring path, the value profile may also comprise both a filtered and a less filtered representation, the filtered representation being obtained by calculating a progressive average of the unfiltered representation. In this connection, for the purpose of obtaining an accurate reference value, it is advantageous if the reference value is determined on the basis of the filtered representation and for the purpose of detecting a document with great reliability it is advantageous if the unfiltered representation is checked for the presence of a portion located beyond the limit value, which is longer than the specified minimum length.

Figure 5:
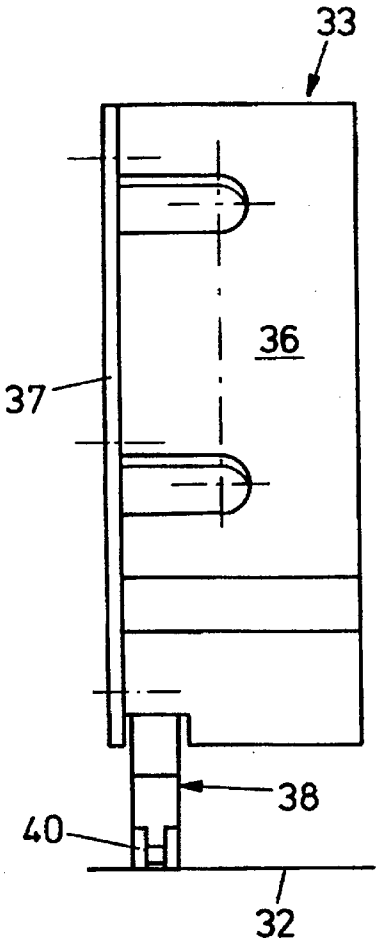
FIG. 5 shows a front view of the scanner according to FIG. 4.
Figure 4:
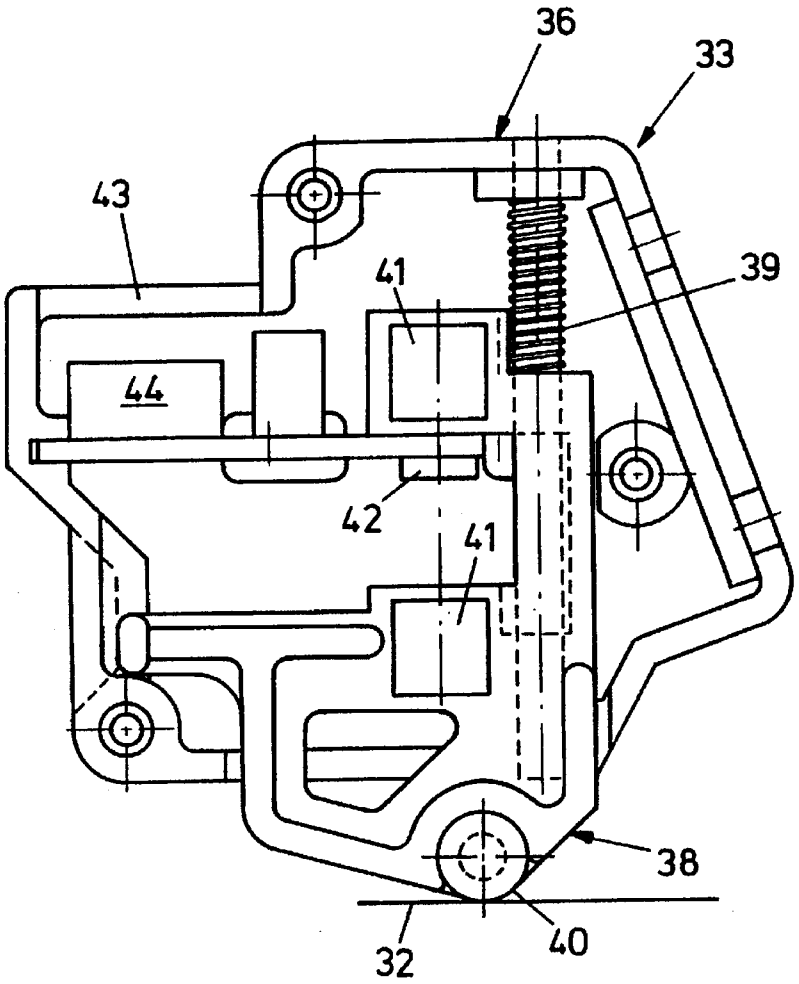
FIG. 4 shows a side elevation of an opened scanner for scanning an envelope along a measuring path.
Figure 6:
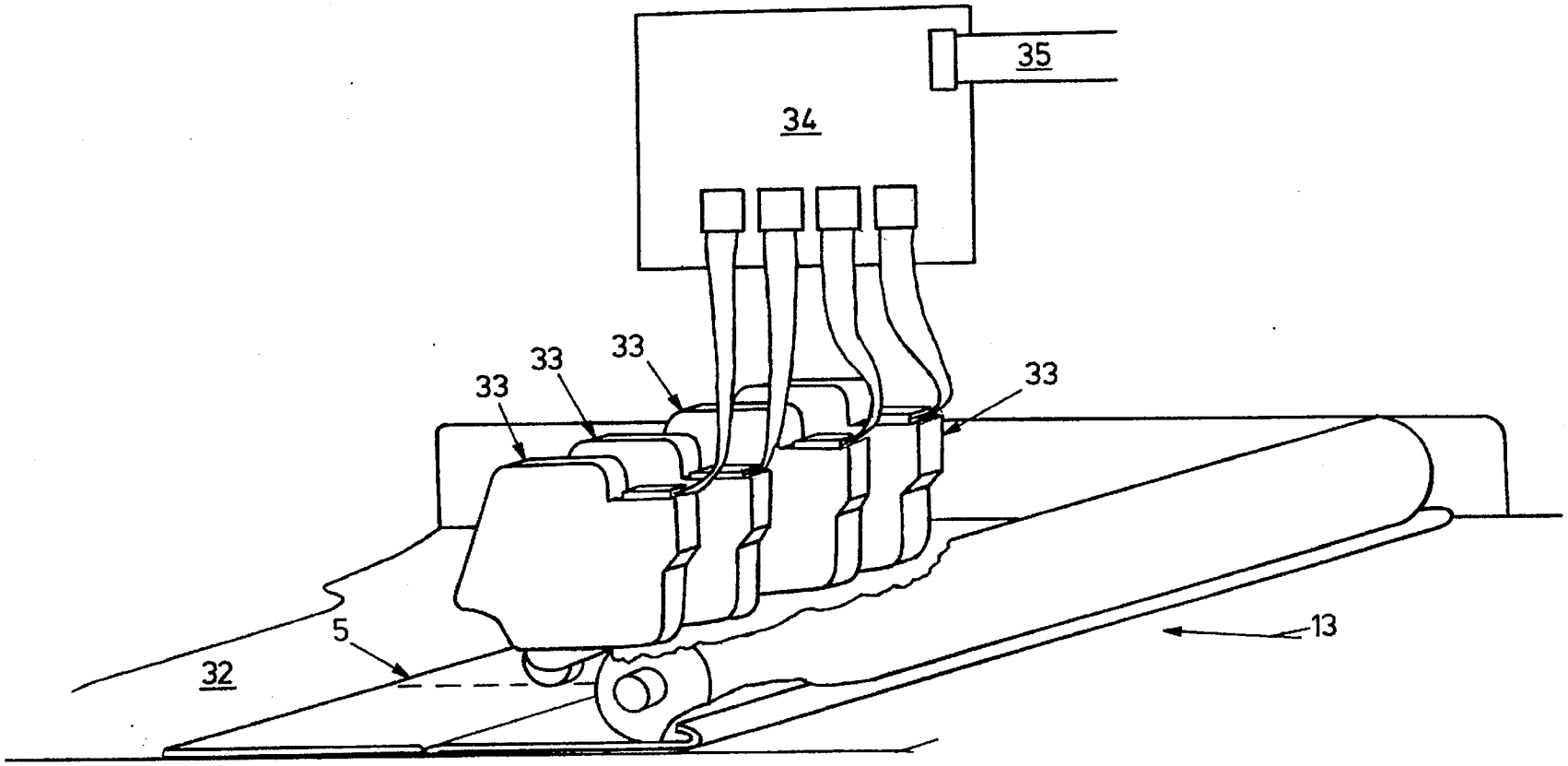
FIG. 6 shows a perspective view of an apparatus according to the invention comprising scanners according to FIG. 5.

FIGS. 4–6 show an apparatus for practicing the method according to the invention. The apparatus comprises a transport path 32 for passing envelopes 5 to be checked one by one along an inspection station. Arranged along the transport path 32 are a plurality of input transducers in the form of scanners 33 for generating an output signal which is variable depending on the thickness of the envelope material 5 passed along the scanners 33.

For generating an envelope-suspect signal the apparatus comprises data processing means, coupled to the scanners, in the form of a printed circuit board 34 which is connected to a main processor via a channel 35. The printed circuit board is adapted for determining and storing value profiles starting from the signals coming from the scanners 33, determining a reference value associated with the envelope material, starting from the value profile, determining an extreme limit value starting from the reference value, and generating an envelope-suspect signal if a continuous portion of the value profile is located beyond the limit value over a specified minimum substantially continuous distance.

Figure 7:
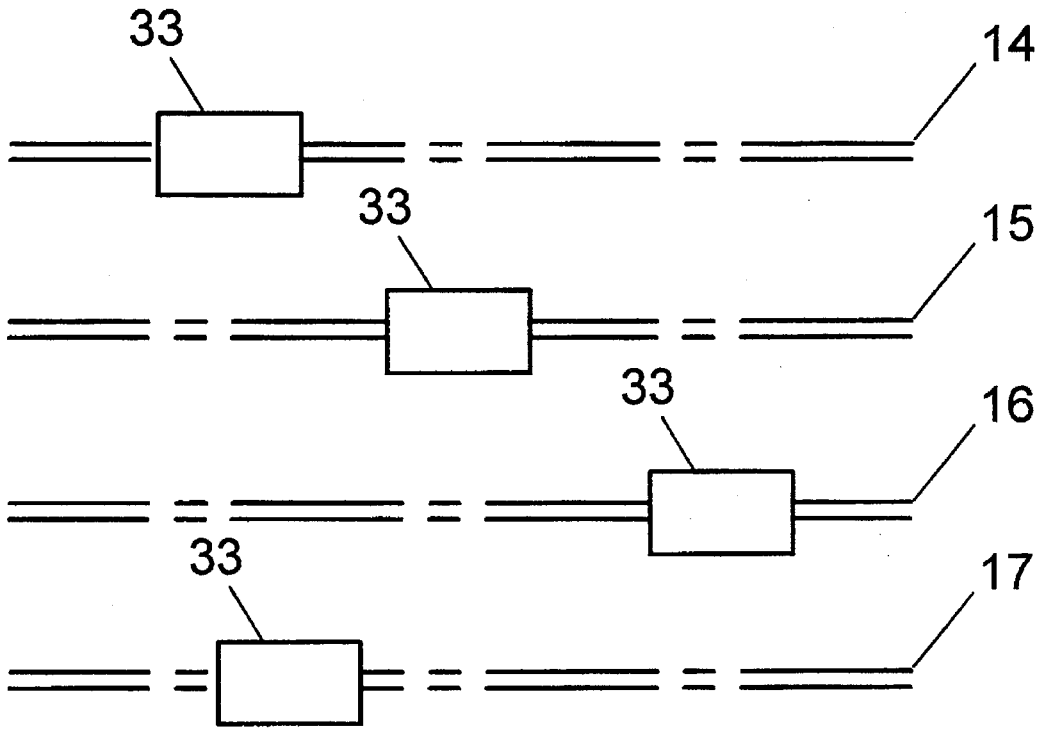
FIG. 7 is a schematic view of an alternative arrangement of the scanners.

The scanners are arranged in positions staggered relative to each other, transversely to the direction of conveyance, so that they can scan an envelope being passed along them through measuring paths which are accordingly spaced relative to each other. The scanners are arranged in a line directed transversely to the transport path, but may moreover be arranged in mutually staggered positions in the direction of conveyance as shown in FIG. 7. This last may be advantageous, for instance if it is desired that envelopes be scanned along very closely spaced measuring paths.

The apparatus may further comprise an output transducer, such as a buzzer, for generating a particular signal that can be observed by the operator and means for activating the output transducer if envelope-suspect signals have been caused by measuring results coming from at least two immediately adjacent input transducers. These means can be part of the printed circuit board 34.

The scanners 33 each comprise a housing 36 closable by means of a cover 37. Accommodated in the housing is a vertically movable follower unit 38 which is pressed towards the transport path by a spring 39. The follower unit 38 comprises a pair of wheels 40 abutting the transport path 32 and rolling over an envelope 5 during the check thereof. The follower unit further comprises a pair of magnets 41 above and below a Hall element 42 fixedly connected to the housing 36. Finally, the housing is provided with an opening 43 through which a connector can be inserted into a connector 44 located behind the opening. When an envelope 5 is passed under the scanners, the follower unit is moved up depending on the course of the thickness of the envelope being checked. The magnets 41 move correspondingly relative to the Hall element 42, so that the voltage in a circuit including the Hall element 42 increases. This voltage can be measured and, via an analog-digital converter, be stored in the data processor for composing a value profile.

I claim:

1. A method for separating documents from an opened envelope and checking whether documents have been separated from the opened envelopes, comprising the steps of, for each individual opened envelope to be checked:

separating contents from an opened envelope;

subsequently conveying the opened envelope on a measuring path past at least one input transducer, which measures a predetermined characteristic of that envelope along a measuring path distance extending over the envelope, determining a value profile from the measured characteristic along said measuring path distance, determining a reference value for that individual envelope from the value profile, determining an extreme limit value for that individual envelope from the reference value, and generating an envelope-suspect signal for that individual envelope if the value profile lies beyond the extreme limit value over a predetermined minimum substantially continuous distance.

2. A method according to claim 1, wherein each envelope is conveyed along the input transducer in a condition opened along three sides and unfolded about a fourth side, a smallest or greatest value of the value profile which is substantially constant over a path of at least a predetermined length is identified and a value corresponding with the substantially constant value of that part is stored as a reference value, and the limit value is determined by adding a tolerance value to this reference value.

3. A method according to claim 2, wherein the value profile is made up of separate, successive values, the smallest or greatest value of the value profile which is substantially constant over a path of at least a predetermined length is identified by identifying series of substantially identical values occurring in succession at least a predetermined number of times and selecting therefrom the series with the smallest or the greatest value.

4. A method according to claim 2, wherein, in determining the reference value, parts of the value profile below or above a predetermined threshold value are skipped.

5. A method according to claim 2, wherein prior to the verification of the envelope a value measured by the input transducer is stored as a base value associated with that envelope and the values measured are stored and processed in the form of differences with regard to the base value.

6. A method according to claim 1, comprising:

storing a value measured by the input transducer prior to the passage of the envelope as a base value, identifying a first part of the value profile of a substantially constant value, which is limited by parts with deviating values and which has a length within a predetermined range, identifying a second, adjacent part of the value profile of a substantially constant value and a predetermined minimum length, determining the difference between the substantially constant values of the first and second parts, storing said difference as the reference value, and determining the limit value by adding once or twice the reference value and a tolerance value to the base value.

7. A method according to claim 6, wherein the value profile is made up of separate, successive values, wherein as a first part, a series of substantially identical values, whose number lies between a predetermined minimum and a predetermined maximum, are identified, and as an adjacent part, a series including at least a predetermined number of substantially identical values are identified.

8. A method according to claim 6, wherein said difference is compared with a predetermined threshold value, and is stored as a reference value only if it lies outside a range limited by the threshold value.

9. A method according to claim 6, wherein, if two or more parts of a value profile have been identified, which have a substantially constant value, are limited by parts with deviating values and have a length lying within a predetermined range, the part with the greatest substantially constant value is identified as said first part of the value profile.

10. A method according to claim 4, wherein, after the passage of an envelope, an envelope-suspect signal is moreover generated if no value associated with that envelope is stored as a reference value.

11. A method according to claim 4, wherein said tolerance value and said threshold value are approximately equal.

12. A method according to claim 5, wherein the envelope is conveyed along at least two input transducers in positions mutually spaced transversely to the direction of conveyance and for each input transducer a base value is stored and the measured values are stored and processed as differences with regard to the base value associated with that input transducer.

13. A method according to claim 1, wherein the envelope is conveyed along at least two input transducers in positions mutually spaced transversely to the direction of conveyance, and a particular signal which can be observed by an operator of the apparatus is generated only if envelope-suspect signals have been caused by measuring results originating from at least two immediately adjacent input transducers.

14. A method according to claim 13, wherein the signal observable by the operator is furthermore generated only if the parts of the respective value profiles that lie beyond the limit value, on the ground of which said envelope-suspect signals have been generated, belong to adjacent parts of the measuring path which overlap in the direction of conveyance.

15. A method according to claim 14, wherein the signal observable by the operator is furthermore generated only if said adjacent parts of the measuring path overlap in the direction of conveyance over a predetermined minimum distance.

16. A method according to claim 1, wherein the input transducer scans the thickness of the envelope and the value profile represents a thickness profile of the envelope along the measuring path.

17. A method according to claim 1, wherein the value profile comprises a filtered representation and a less filtered representation, the filtered representation being obtained by calculating a progressive average of the unfiltered representation, the reference value being determined on the basis of the filtered representation and the unfiltered representation being checked for the presence of a part that lies outside the range limited by the limit value and is longer than the predetermined minimum length.

18. An apparatus for separating documents from opened envelopes and for checking whether documents have been separated from the opened envelopes, comprising:

separating means for separating contents from opened envelopes;

a conveyor track for passing opened envelopes to be checked individually from said separating means along an inspection station, said inspection station including at least one input transducer arranged on the conveyor track for generating an output signal responsive to a characteristic of the envelope material passed along the input transducer, and means for generating an envelope-suspect signal, comprising data processing means, coupled to receive the output signal of the input transducer, for determining a value profile for each individual envelope from the signal originating from the input transducer for the individual envelope, storing said value profile, determining a reference value for the envelope material of the individual envelope from the value profile, determining an extreme limit value from the reference value, and generating an envelope-suspect signal if a continuous part of the value profile for the individual envelope lies beyond the extreme limit value over a predetermined minimum substantially continuous distance.

19. An apparatus according to claim 18, comprising at least two input transducers in positions mutually spaced transversely to the direction of conveyance.

20. An apparatus according to claim 19, comprising an output transducer for generating a particular signal observable by an operator of the apparatus and means for activating the output transducer in reaction to envelope-suspect signals that have been caused by measuring results originating from at least two immediately adjacent input transducers.

21. A method according to claim 19, wherein the positions of the at least two transducers are relatively staggered in the direction of movement of the conveyor.

* * * * *